United States Patent [19]

Hubert

[11] 4,176,618

[45] Dec. 4, 1979

[54] TRIGGERING DEVICE FOR COMBUSTION DETECTOR

[75] Inventor: Gustav Hubert, San Gabriel, Calif.

[73] Assignee: Notifier Company, Lincoln, Nebr.

[21] Appl. No.: 924,368

[22] Filed: Jul. 13, 1978

[51] Int. Cl.[2] ..... G08B 17/00

[52] U.S. Cl. ..... 116/102

[58] Field of Search ..... 116/4, 5, 67.5, 101, 116/102; 340/628, 577

[56] References Cited

U.S. PATENT DOCUMENTS

| | | | |
|---|---|---|---|
| 2,521,469 | 9/1950 | Marks | 116/102 |
| 2,634,058 | 4/1953 | Marks | 116/102 X |
| 3,452,706 | 7/1969 | Vogt | 116/102 |
| 3,559,614 | 2/1971 | Cushman | 116/102 |
| 3,570,446 | 3/1971 | Buford | 116/102 |
| 4,121,533 | 10/1978 | Pappas | 116/5 |

*Primary Examiner*—Donald Watkins

*Attorney, Agent, or Firm*—Poms, Smith, Lande & Rose

[57] ABSTRACT

A triggering device for fire and smoke alarms in which a biased pin member is held in armed position by a latch element which is releasable when a bimetallic disc senses and responds to a selected temperature condition. The response of the disc is transmitted through a ball or antifriction element to which is imparted a lateral force for moving the latch element out of engagement with the pin member. The pin member is spring biased to urge the pin member against a member serving to cause actuation of the alarm.

11 Claims, 7 Drawing Figures

TRIGGERING DEVICE FOR COMBUSTION DETECTOR

BACKGROUND OF INVENTION

Fire and smoke alarm devices are designed to respond to a selected temperature or a selected condition to cause actuation of a signal which provides an audible warning. Some fire alarms are mechanically actuated and include mechanical alarm means. An example of such an alarm device is that shown in U.S. Pat. No. 3,570,446 issued Mar. 16, 1971 owned by a common assignee.

In the fire detection alarm means of said patent, a trigger means was cooperably connected with a thermal responsive device which included a bimetallic disc adapted to snap from a convex shape to a concave shape and during such transition, to forceably contact an axially movable spacer element. The inner end of the spacer element provided a seat for one end of an axially displaceable pin which carried a shoulder upon which was seated a lever trigger member which released the mechanical alarm. Precise positioning of the several parts of the triggering device in relation to the bimetallic disc and the actuating alarm lever was required to assure reliable actuation of the triggering device for actuation of the alarm. Manufacturing tolerances and friction between the several parts made such setting a delicate, relatively time-consuming operation. Because the forces involved as initiated by the bimetallic disc were not of large magnitude, adjustment of the triggering device at the factory was required to be precise and the presence of dust or foreign particles, and thermal expansion or constraction or deformation of components caused by stressing when installed for a period of time might cause the triggering device to be inoperable.

There is, therefore, a need for a triggering device for such an alarm which did not require precise assembly, adjustment, and manufacturing tolerances.

SUMMARY OF INVENTION

The present invention contemplates a triggering device for such an alarm as described above, as well as for other devices or apparatuses which are actuated in response to a selected condition. The triggering device contemplated by the present invention is positive in operation and includes a novel means for transmitting the displacing forces in a bimetallic disc into latch release forces. The invention contemplates a triggering device in which forces of small magnitude are employed to cause release of forces of much greater magnitude as required by the apparatus and through the use of a latch element displaced in one example by an anti-friction release element responsive to the bimetallic disc.

Generally speaking, the present invention contemplates a triggering device for a fire or smoke alarm which avoids the disadvantages of those devices which utilize a nonamplified force emanating from a sensing and responsing means.

The primary object of the present invention is to disclose a novel triggering device particularly adapted for use with fire or smoke alarms and adapted for use with other devices requiring response to a selected condition.

An object of the present invention is to disclose a triggering device which is reliable in operation and which has a structure and arrangement which does not require precise adjustment.

Another object of the present invention is to provide a triggering device for transmitting movement of a condition responsive member into movement or displacement of a latch element for release of a spring biased member for causing actuation of the device.

A further object of the present invention is to provide a triggering device in which the displacing forces in one direction of a bimetallic disc are used to provide latch release forces for releasing a spring biased signal actuator member from one position. In one example, the displacing forces of one direction are transmitted into latch release forces in a lateral direction by novel means. In another example, the displacing forces in one direction are transmitted as latch release forces in the same direction, although such direction is normal to the movement of the released biased signal actuator member.

The invention specifically contemplates a molded body member adapted to be assembled with means for sensing and responding to a selected condition, an axially movable pin member in said body member and biased in one direction relative thereto, means in said body member for releasably holding said pin member in one position against said bias and including a latch and a spring biasing said latch into holding engagement with said pin member, and means to transmit response of said sensing means to said latch to overcome the bias of said latch holding spring and to release said pin member, the response transmitting means including a ball and an inclined surface on said body member for causing lateral movement of the ball when contacted by the sensing means.

Various other objects and advantages of the present invention will be readily apparent from the following description of the drawings in which an exemplary embodiment of this invention is shown.

IN THE DRAWINGS

An alarm device generally indicated at 10 which embodies a triggering device generally indicated at 11 may comprise a mechanically actuated fire alarm of the type shown in U.S. Pat. No. 3,570,446 issued Mar. 16, 1971 owned by a common assignee. In the device shown in U.S. Pat. No. 3,570,446, a triggering device therein includes axial movement of a pin for release of a lever from its engagement with a rotatable set of hammers for sounding an alarm signal. The rotatable hammers are driven by a clock spring. In the alarm device of said patent, axial movement of the pin to release the alarm is imparted by a bimetallic disc responsive to a selected heat condition whereby snapping of the bimetallic disc to its actuated position imparts an axial force to the pin for causing displacement of the lever and release of the alarm. The present invention provides an improved triggering device for the alarm. In this respect it will be understood that while the triggering device hereinafter described is shown by way of example with an alarm device of the type shown in U.S. Pat. No. 3,570,446, the present triggering device may be used in many other situations where sensing of a selected condition and response thereto is desired for causing actuation of an alarm for some other equipment. Therefore, the exemplary triggering device 11 herein described is not limited in its application to a fire alarm device.

Figure 2:
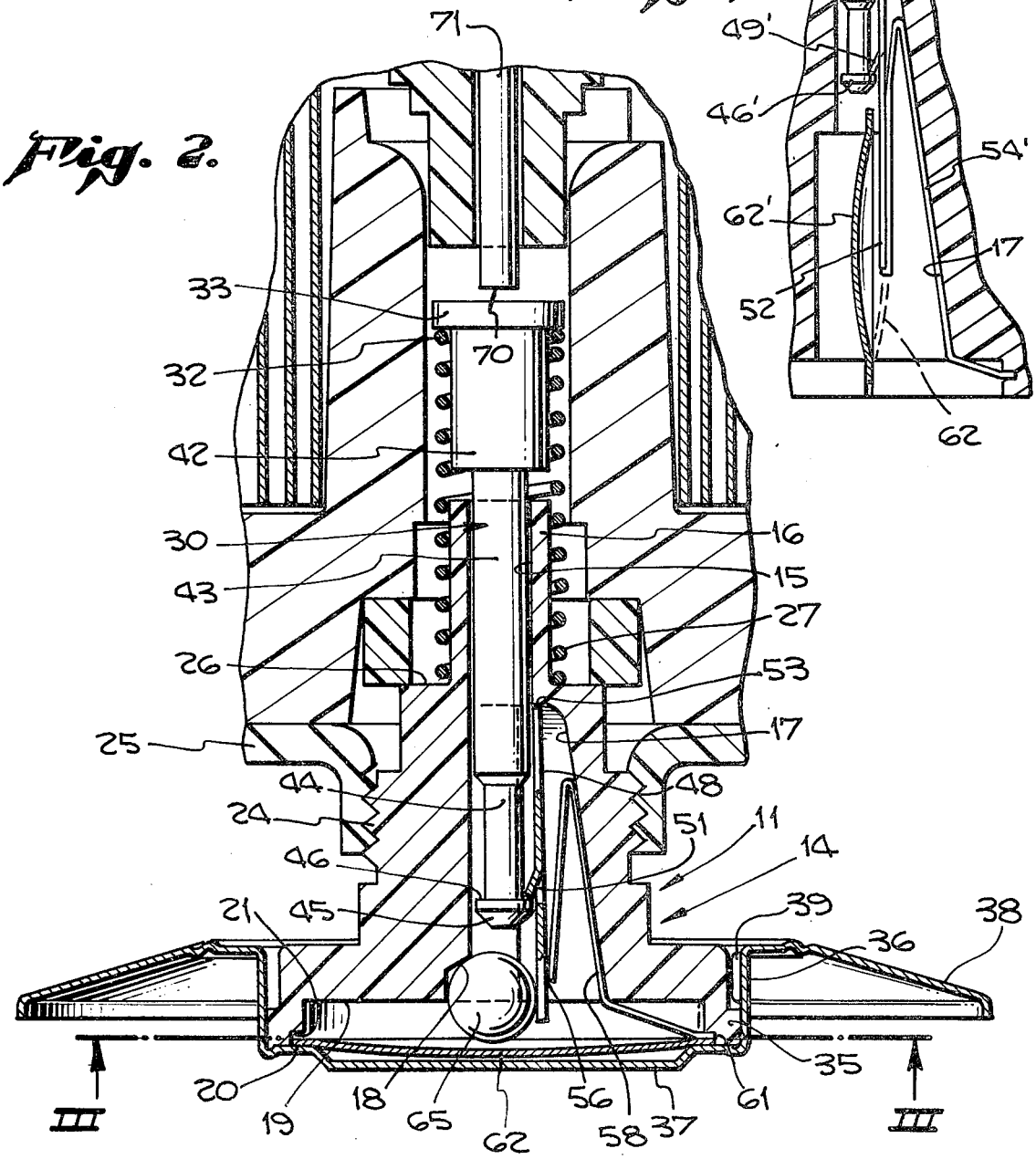
FIG. 2 is an enlarged fragmentary sectional view of that part of the alarm device which embodies this invention, the section being taken in the plane indicated by line II—II of FIG. 1.
Figure 3:
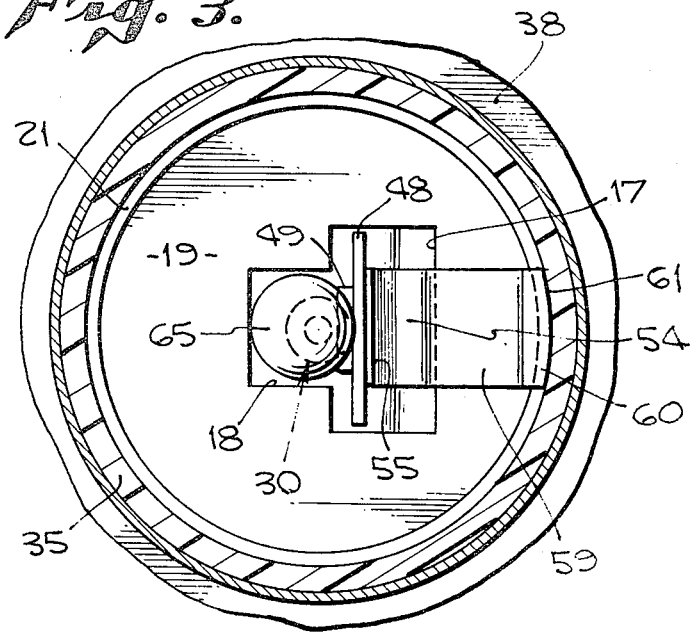
FIG. 3 is a fragmentary sectional view taken in a transverse plane indicated by line III—III of FIG. 2.
Figure 4:
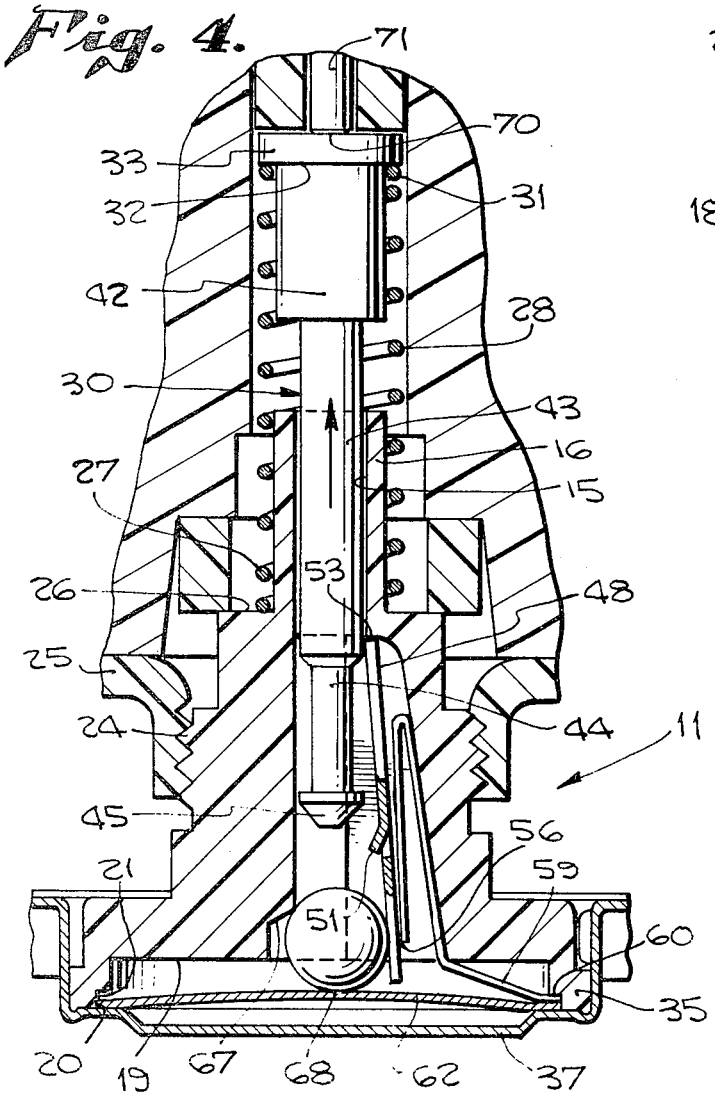
FIG. 4 is a sectional view taken in the same plane as FIG. 2 illustrating the triggering device embodying this invention in actuated condition.
Figure 5:
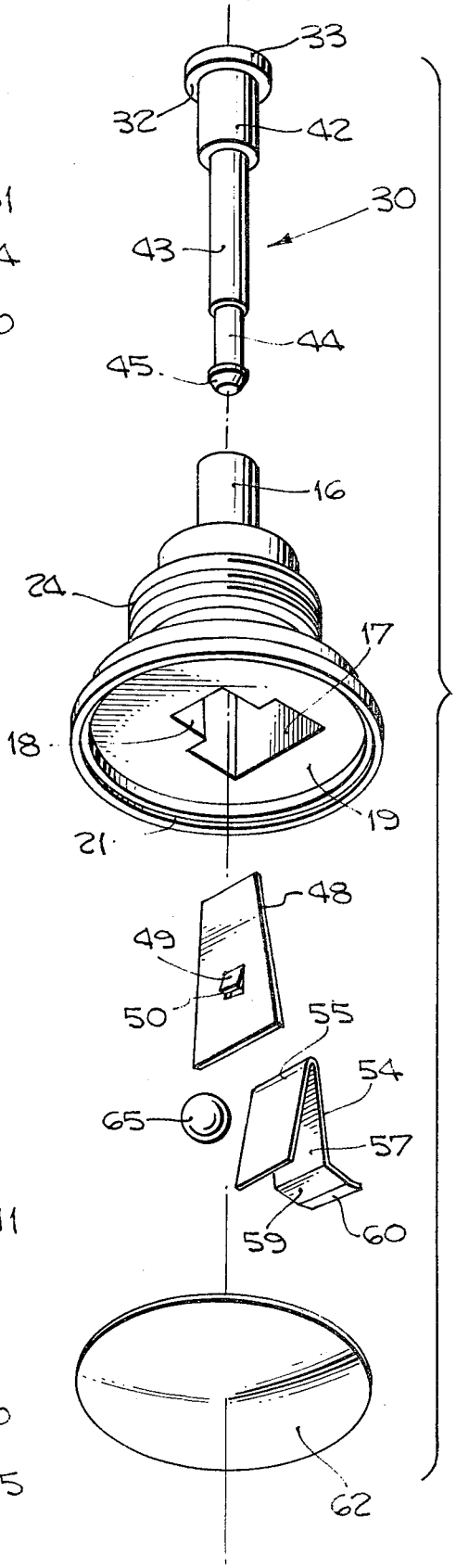
FIG. 5 is an enlarged exploded perspective view of the elements of the triggering device embodying the invention.

The triggering device 11 (FIG. 2) may comprise an elongated body member 14 of molded plastic material having an axial throughbore 15 at an inner cylindrical reduced portion 16. Throughbore 15 opens into a laterally extending body chamber 17 and adjacent its outer end to an opposite laterally disposed recess 18. Chamber 17 and recess 18 open into an annular coaxial recess 19 provided with an outer annular recess 20 defining a shoulder 21 with recess 19.

Intermediate ends of body member 14, the surface thereof is provided with external threads 24 for threaded engagement with wall 25 of the alarm device for mounting of the body member in said wall. Body member 14 also includes an inwardly facing annular shoulder 26 which provides a seat for one end 27 of a coil spring 28 for biasing a pin member 30 received within bore 15 in one direction. Upper end 31 of spring 28 is seated against an annular shoulder 32 provided at the inner end 33 of pin member 30.

The outer end 35 of body member 14 is received within a cup shaped portion 36 of a heat collector element 37 which extends over and covers the outer end 35 of body member 14. Heat collector 37 includes an outwardly extending conical flange 38 for increasing heat collecting area of said collector 37. In final assembly, cup shaped portion 36 may be staked as at 39 to secure collector 37 on the outer end 35 of body member 14.

Pin member 30 includes an inner cylindrical portion 42 of approximately the same diameter as the diameter of inner portion 16 of body member 14. Intermediate portion 43 of the pin member is loosely slideably fitted within the bore 15 to provide free movement of pin 30 and axial alignment thereof. Intermediate portion 43 terminates in a reduced end portion 44 which defines with a generally conical shaped head 45, an annular shoulder 46 serving as a latch engagement face.

Latch means for holding pin member 30 in armed position may comprise a latch element 48 of thin flat metal and of generally slightly trapezoidal shape. Latch element 48 may be of any elongated configuration, the tapered trapezoidal shape being provided to conform generally with the tapering section of body chamber 17 which is tapered in accordance with molding practice. Latch element 48 includes a struck out holding lug 49 which provides an edge 50 spaced from the plane of element 48 for engagement as at 51 with the annular shoulder 46 on pin 30.

In assembly, latch element 48 is seated as at 53 on the bottom wall of body chamber 17 and is biased laterally inwardly toward the axis of the body member by a biasing leaf spring 54. Leaf spring 54 is folded to provide a leaf portion 55 having an upper edge bearing against latch element 48 as at 56, a leaf portion 57 which rests against the side wall of body chamber 17 as at 58. The outer end of leaf portion 57 terminates in a bent end portion 59 which has a margin 60 adapted to seat on recess 21 as at 61 for securing spring 54 during assembly.

Figure 1:
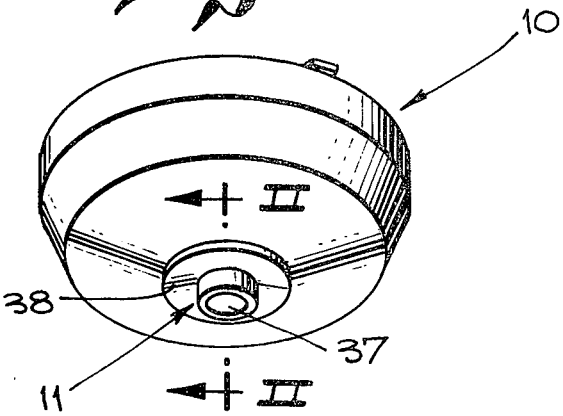
FIG. 1 is a perspective view of an alarm device embodying this invention.
Figure 6:
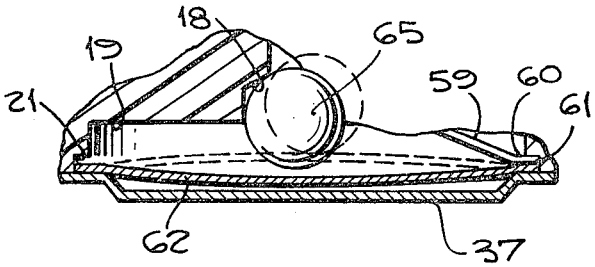
FIG. 6 is a fragmentary sectional view taken in the same plane as FIG. 2 and showing a position of the ball element when the triggering device is armed and in phantom lines showing the ball device when the triggering device is actuated.

Covering the outer end of chamber 17 and recess 19 is a bimetallic circular disc 62 which serves as a sensing means to sense a selected condition such as 135° F. and to respond to such temperature by snapping from an outwardly convex shape to an inwardly concave shaped as illustrated in FIG. 6. Bimetallic disc 62 has a diameter corresponding to the diameter of the shouldered recess 20 in the body member and circumferential margins of disc 62 are received in said recess 20 in assembly. Bimetallic disc 62 may be of any well-known manufacture and bimetallic discs responsive to other temperatures, if desired, may be employed to sense a selected condition.

Means for transmitting response of disc 62 to a selected condition includes a laterally movable element 65, in this example, a small metal ball. Ball 65 is positioned in armed condition of the triggering device against and partially in the lateral recess 18 in body member 14. The depth and lateral dimensions of recess 18 are such that when the latch element is in latch engaged position, as in FIG. 2, the center of the ball may be spaced slightly from the axis of pin member 30. Further, the diameter of the ball is such that when the disc 62 is in its convex normal position, ball 65 will not fall out of its desired position in recess 18 and in contact with the laterally inwardly biased end of latch element 48. Further, recess 18 includes an inclined surface 67 which permits ball 65 to move laterally and inwardly towards latch element 48.

Thus, in operation, when bimetallic disc 62 senses a selected condition such as 135° F. and snaps from an outer convex shape to an inner concave shape, the inner surface of disc 62 contacts the ball as at 68 and causes the ball to be forced against the inclined surface 67 of recess 18 which imparts a horizontal component of force to the ball. The ball transmits the horizontal component of force to the upper end of latch element 48. Further, the lateral component of force imparted to ball 65 causes ball 65 to laterally move the upper end of latch element 48 against the bias of leaf portion 55 to cause release of holding tab 49 with shoulder 46. Upon such release of latch element 48 from pin member 30, pin member 30 is positively inwardly moved by the compressed coil spring 28. Release of pin 30 causes its inner end 33 to forceably contact the end face 70 of transfer pin 71 to axially displace pin 71 for release of the lever in the alarm device shown in U.S. Pat. No. 3,570,446 or for actuation of other suitable devices.

The force created by snapping of the bimetallic disc 62 from convex to concave position is relatively small. The elimination or reduction of substantial amounts of friction between the parts of the triggering device thus becomes very important. Ball element 65 is contacted by the disc at essentially a tangential point of minimum surface area. The contact of ball 65 with the inclined surface 67 is also on a tangential point of minimum area. Thus, inward and lateral movement of ball 65 is positive and virtually unrestricted by frictional forces.

The triggering device 11 may be reset by axially moving transfer pin 71 to compress spring 28 until the holding lug 49 slides over the conical nose 45 of the pin member and is snapped into holding engagement with shoulder 46 by the leaf portion 55 of leaf spring 54.

The triggering device 11 described above is so arranged and constructed as to facilitate production assembly. Pin member 30 is ensleeved within coil spring 28 and the assembled spring and pin members are then assembled with the inner portion 16 of the body member 14. Latch element 48 is then dropped into body chamber 17. Spring member 54 is inserted into the body chamber and the coil spring 28 compressed until the holding lug 49 latches onto the pin member. Ball 65 is placed in its recess 18 and in contact with the outer end of latch element 48. The bimetallic disc is then placed over the ball and chamber opening and is received in the annular recess 20. The heat collector 37 is then placed over the end of the body member and disc 62 and confines the disc 62 in its recess 20. The cup shaped portion 36, which now receives the outer end of the body member, may be staked as at 39 to secure the assembly. The trigger means is then ready for threaded assembly with the alarm device as shown.

Figure 7:
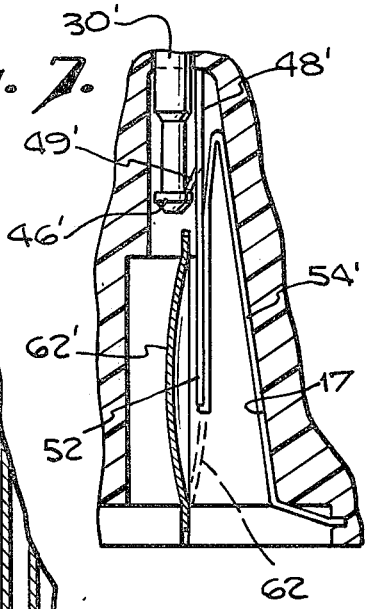
FIG. 7 is a fragmentary schematic view of another embodiment of this invention.

In FIG. 7 a different embodiment or arrangement of the latch release means is shown. As in the above-described embodiment, latch member 48' has a holding lug 49' engageable with the annular shoulder 46' of the pin 30'. Latch member 48' is biased into holding engagement with pin 30' by leaf spring 54'.

In this embodiment of the invention, bimetallic disc 62' is turned 90° from the prior example and is positioned so that the center of the disc 62' is in spaced relation to the end portion 52 of latch member 48'. The positioning of the bimetallic disc 62' is also such that when the disc responds to a selected condition and snaps from concave to convex configuration, the center portion of the disc 62' will strike the end portion 52 of the latch member 48' and cause disengagement of lug 49' with shoulder 46'. It is understood that some modification of the body chamber may be required to so position the bimetallic disc 62' and that a heat collector means 37 may be redesigned for such use or may be omitted.

It will be apparent that in the modification of the invention shown in FIG. 7 that the direction of the forces provided by the bimetallic disc are transmitted in the same direction to the latch member 48'.

It will thus be apparent that a positive foolproof triggering device is provided by the construction described above. Various changes and modifications may be made in such construction which fall within the spirit of this invention and all such changes and modifications coming within the scope of the appended claims are embraced thereby.

I claim:

1. In an alarm device having alarm signal means; the combination of:

a body member having a through bore and a body chamber at one side of said bore at one end thereof;

a pin member longitudinally slideable in said bore and terminating opposite said chamber;

spring means on said body member adjacent the other end of said bore and engaged by said pin member for biasing said pin member in one direction;

a condition sensing and responsive means adjacent the one end of said bore and spaced from the adjacent end of said pin member;

biased latch means in said body chamber engageable with said pin member adjacent the one end of the bore to retain said pin member in one position against the bias of said spring means;

and means opposite to said body chamber in contact with said latch means adapted to be moved toward said body chamber by said condition sensing means to release said latch means from said pin member for movement of said pin member in said one direction to cause actuation of said alarm signal means.

2. In an alarm device having alarm signal means; the combination of:

a body member having a through bore and a body chamber disposed laterally with respect to said bore;

a pin member longitudinally slideable in said bore;

spring means on said body member adjacent one end of said bore and engaged by said pin member for biasing said pin member in one direction;

a condition sensing and responsive means adjacent the other end of said bore and spaced from the adjacent end of said pin member;

biased latch means in said body chamber engageable with said pin member to retain said pin member in one position against the bias of said spring means;

and means in said body chamber in contact with said latch means and adapted to be moved by said condition sensing means to release said latch means from said pin member for movement of said pin member in said one direction to cause actuation of said alarm signal means said means in said body chamber in contact with said latch means comprising a ball.

3. A device as claimed in claim 1 wherein said means in said body chamber in contact with said latch means includes a laterally movable element.

4. In a device as claimed in claim 2 wherein said body chamber includes a recess for partially receiving said means in contact with said latch means, said recess including an inclined surface.

5. In a device as claimed in claim 1 wherein said conditioning sensing and responsive means includes a concave-convex bimetallic disc having movement in one direction in response to a sensed condition to displace said means in said body chamber in contact with said latch means.

6. A triggering device responsive to a selected condition, comprising in combination:

a body member;

means on said body member for sensing said selected condition;

a pin member in said body member to be axially moved and biased in one direction relative to said body member;

means in said body member for releasably holding said pin member in one position against said bias including a latch, and a spring biasing said latch into holding engagement with said pin member; and means to transmit response of said sensing means to said latch to overcome the bias of said latch holding spring and to release said pin member;

said means to transmit response of said sensing means to said latch includes an inclined surface disposed laterally with respect to a portion of said latch, and an element on said inclined surface to be moved by said sensing means to release said latch from said pin member.

7. A triggering device as claimed in claim 6 wherein said element is a ball.

8. In combination with a combustion detector device:

means for sensing and responsive to a selected condition;

means for transmitting response of said sensing means into movement of a member to cause a signal;

said transmitting means including means releasably retaining said member in one position;

and means actuated by said responsive means to release said retaining means for movement of said member from said one position to a second position;

said means actuated by said responsive means including a ball for contact by said sensing means, and a latch element engaged with said member and movable out of engagement with said member upon contact of said ball therewith when said ball is moved by said sensing means.

9. In a triggering device for an actuator member to cause means to be actuated at one end of said member upon movement of the member in one direction, the member having a contact portion at one end for contact with said actuated means, a biasing means for said member, means for holding the actuator member against said biasing means, the provision of:

a movable portion on said holding means adjacent the opposite end of the actuator member a condition sensing means adjacent to the opposite end portion of said actuator member and adjacent to said movable portion of said holding means, said condition sensing means being arranged to transmit its response to a selected condition to said movable portion of said holding means through forces acting in a direction other than said one direction, whereby adjustment of the position of said end contact portion of said actuator member with respect to the actuated means is independent of the displacement of the condition sensing means in response to a selected condition to impart its force to the holding means for release of the actuation member.

10. In a device as stated in claim 9 wherein said condition sensing means is positioned alongside and generally parallel to said holding means and in condition sensed position is adapted to contact said holding means for release thereof.

11. In a triggering device as stated in claim 9 wherein said condition sensing means is provided displacement in said one direction in response to a sensed condition;

and means including a sidewardly movable element translating said latter movement into a direction to release said holding means.

* * * * *